US007299513B1

(12) United States Patent
Barrett et al.

(10) Patent No.: US 7,299,513 B1
(45) Date of Patent: Nov. 27, 2007

(54) BLADDER SUPPORT SYSTEM

(75) Inventors: Andrew N. Barrett, Spokane, WA (US); Craig G. Dolsby, Spokane, WA (US)

(73) Assignee: F.O. Berg Company, Spokane, WA (US)

( * ) Notice: Subject to any disclaimer, the term of this patent is extended or adjusted under 35 U.S.C. 154(b) by 0 days.

(21) Appl. No.: 11/466,906

(22) Filed: Aug. 24, 2006

Related U.S. Application Data

(60) Provisional application No. 60/712,030, filed on Aug. 29, 2005.

(51) Int. Cl.
*A47C 27/08* (2006.01)
*A47C 31/00* (2006.01)

(52) U.S. Cl. ..... 5/654; 5/655.5

(58) Field of Classification Search ..... 5/654, 5/655.3, 644, 706, 710, 713, 490, 496, 737, 5/738, 655.5, 665, 668, 669, 675, 686, 692, 5/700

See application file for complete search history.

(56) References Cited

U.S. PATENT DOCUMENTS 2,700,778 A * 2/1955 Syracuse ..... 5/496
3,900,909 A * 8/1975 Monier et al. ..... 5/496
3,935,604 A * 2/1976 Collins ..... 5/630
4,042,988 A * 8/1977 Holliday ..... 5/710
4,712,261 A * 12/1987 Castro ..... 5/499
4,815,154 A * 3/1989 Grimes ..... 5/657
4,839,932 A * 6/1989 Williamson ..... 5/615
4,862,533 A * 9/1989 Adams, III ..... 5/413 R
4,873,731 A * 10/1989 Williamson ..... 5/615
5,057,819 A * 10/1991 Valenti ..... 340/573.1
5,109,559 A * 5/1992 West ..... 5/668
5,163,192 A * 11/1992 Watson ..... 5/419
5,303,977 A * 4/1994 Sereboff ..... 297/230.1
5,375,273 A * 12/1994 Bodine et al. ..... 5/710
5,421,044 A * 6/1995 Steensen ..... 5/710
5,423,094 A * 6/1995 Arsenault et al. ..... 5/655.3
5,487,197 A * 1/1996 Iskra et al. ..... 5/655.3
5,737,785 A * 4/1998 Casey ..... 5/419
5,740,565 A * 4/1998 McDade ..... 5/413 AM
5,745,942 A * 5/1998 Wilkerson ..... 5/715
5,895,118 A * 4/1999 Hensley ..... 383/3
5,926,873 A * 7/1999 Fountain ..... 5/424
5,956,787 A * 9/1999 James et al. ..... 5/713
5,966,762 A * 10/1999 Wu ..... 5/713
6,006,383 A * 12/1999 Pile et al. ..... 5/706
6,065,166 A * 5/2000 Sharrock et al. ..... 5/630
6,085,372 A * 7/2000 James et al. ..... 5/713
6,161,231 A * 12/2000 Kraft et al. ..... 5/18.1

(Continued)

FOREIGN PATENT DOCUMENTS

GB 2188839 A * 10/1987

*Primary Examiner*—Robert G. Santos
(74) *Attorney, Agent, or Firm*—Michael S. Neustel

(57) ABSTRACT

A bladder support system for reducing the stresses placed upon a bladder unit. The bladder support system includes a bladder unit fillable with a fluid, a base member comprised of a sheet structure, wherein the base member is positioned adjacent to the bladder unit and a plurality of straps attached to the base member. The plurality of straps are comprised of an elongated structure and removably attach the base member to the bladder unit in such a manner in which the plurality of straps and the base member encompass the bladder unit.

18 Claims, 5 Drawing Sheets

U.S. PATENT DOCUMENTS 6,240,584 B1 * 6/2001 Perez et al. ..... 5/713
6,418,579 B2 * 7/2002 Perez et al. ..... 5/713
6,568,013 B2 * 5/2003 Perez et al. ..... 5/710
6,951,039 B2 * 10/2005 Roseff ..... 5/706
7,086,104 B1 * 8/2006 Tsay ..... 5/655.3
7,086,533 B1 * 8/2006 Enko ..... 206/579
2002/0133879 A1 * 9/2002 Smith et al. ..... 5/413 R
2003/0028971 A1 * 2/2003 Chaffee ..... 5/706
2004/0255379 A1 * 12/2004 Zheng ..... 5/413 AM
2006/0168735 A1 * 8/2006 Tsay ..... 5/655.3

* cited by examiner

BLADDER SUPPORT SYSTEM

CROSS REFERENCE TO RELATED APPLICATIONS

I hereby claim benefit under Title 35, Untied States Code, Section 119(e) of U.S. provisional patent applications Ser. No. 60/712,030 filed Aug. 29, 2005. The 60/712,030 application is currently pending. The 60/712,030 application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to bladder systems and more specifically it relates to a bladder support system for reducing the stresses placed upon a bladder unit.

2. Description of the Related Art

Any discussion of the prior art throughout the specification should in no way be considered as an admission that such prior art is widely known or forms part of common general knowledge in the field.

Bladder systems have been in use for years. Typically, bladder systems are used for containing fluid such as, but not limited to fuels, water, and chemicals. Many bladder systems are also comprised of a fabric material. The fabric material can have many benefits in bladder systems such as, but not limited to easy mobility and a resilient nature. Bladder systems can be very large in size and because of this the bladder systems may have to withstand large amounts of pressure from the contained fluid.

Over time bladder systems generally start to leak because of the tremendous amount of pressure that is placed on the fabric from the fluids inside. This pressure may also expose another problem with a conventional bladder such as bladder systems ripping open resulting in catastrophic failure and creating a safety hazard to anyone in the vicinity.

While these devices may be suitable for the particular purpose to which they address, they still lack a suitable solution for providing support to the fabric fluid bladder unit in order to reduce the stress placed on the bladder unit once it contains fluid. Conventional bladder systems are known to rupture over time which may be attributed to the constant pressure of the contained fluid inside the bladder system's walls. Bladder systems rupturing can be very dangerous to the people around the bladder system.

In these respects, the bladder support system according to the present invention substantially departs from the conventional concepts and designs of the prior art, and in so doing provides an apparatus primarily developed for the purpose of reducing the stresses placed upon a bladder unit.

BRIEF SUMMARY OF THE INVENTION

In view of the foregoing disadvantages inherent in the known types of bladder systems now present in the prior art, the present invention provides a new bladder support system construction wherein the same can be utilized for reducing the stresses placed upon a bladder unit.

The general purpose of the present invention, which will be described subsequently in greater detail, is to provide a new bladder support system that has many of the advantages of the bladder systems mentioned heretofore and many novel features that result in a new bladder support system which is not anticipated, rendered obvious, suggested, or even implied by any of the prior art bladder systems, either alone or in any combination thereof.

To attain this, the present invention generally comprises a bladder unit fillable with a fluid, a base member comprised of a sheet structure, wherein the base member is positioned adjacent to the bladder unit and a plurality of straps attached to the base member. The plurality of straps are comprised of an elongated structure and removably attach the base member to the bladder unit in such a manner in which the plurality of straps and the base member encompass the bladder unit.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a bladder support system that will overcome the shortcomings of the prior art devices.

A second object is to provide a bladder support system for reducing the stresses placed upon a bladder unit.

Another object is to provide a bladder support system that may be integrally formed with a bladder system.

An additional object is to provide a bladder support system that reduces bladder system ruptures.

A further object is to provide a bladder support system for lowering the weld stress on the bladder system, thus avoiding catastrophic failure.

Another object is to provide a bladder support system for encompassing the bladder unit in such a way that the pressure is placed on the bladder support system instead of the bladder unit.

Another object is to provide a bladder support system for limiting the bladder unit from being overfilled.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
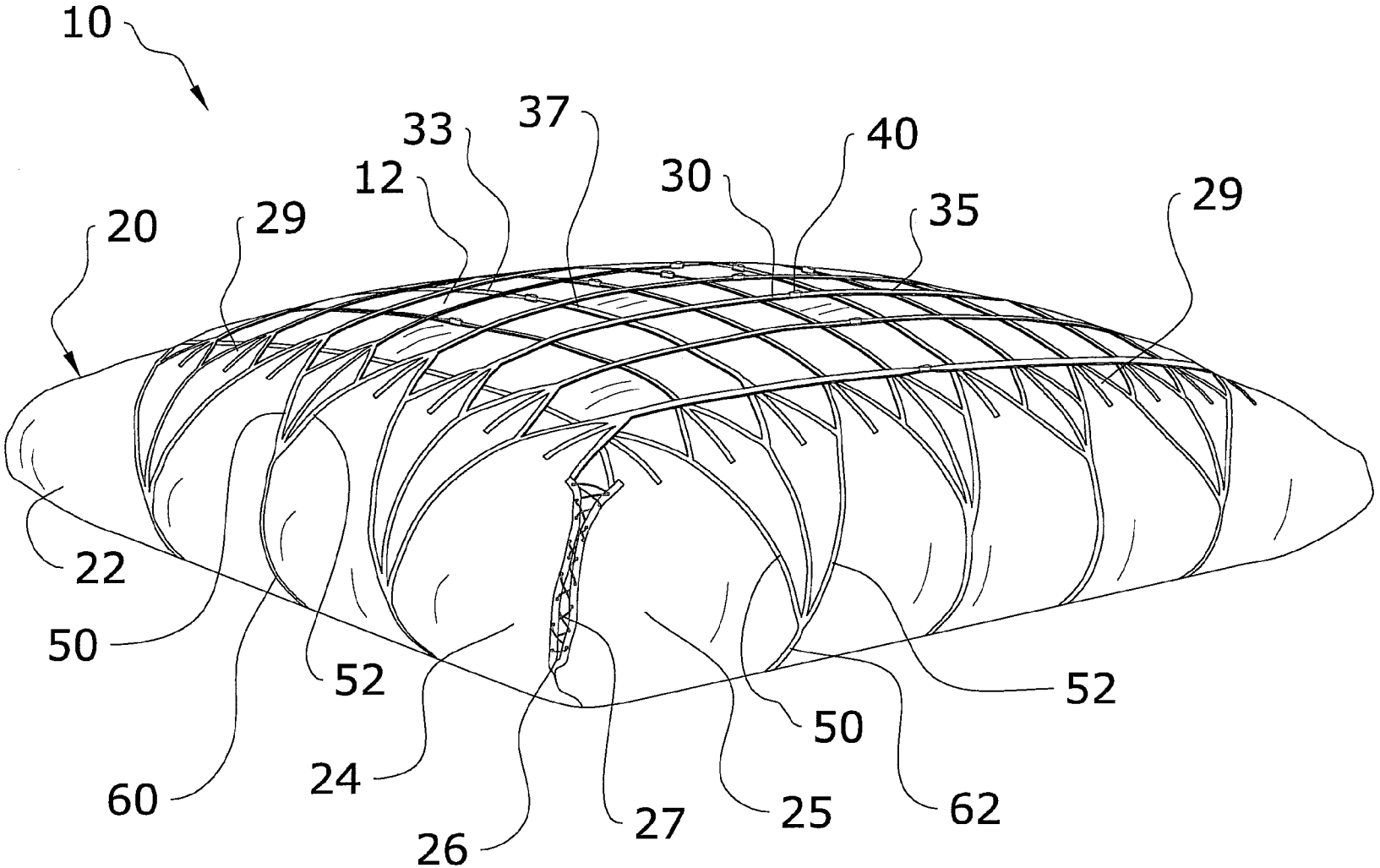
FIG. 1 is an upper perspective view of the present invention in use.

Turning now descriptively to the drawings, in which similar reference characters denote similar elements throughout the several views, FIGS. 1 through 5 illustrate a bladder support system 10, which comprises a bladder unit 12 fillable with a fluid, a base member 20 comprised of a sheet structure, wherein the base member 20 is positioned adjacent to the bladder unit 12 and a plurality of straps 30 attached to the base member 20. The plurality of straps 30 are comprised of an elongated structure and removably attach the base member 20 to the bladder unit 12 in such a manner in which the plurality of straps 30 and the base member 20 encompass the bladder unit 12. The bladder unit 12 is preferably comprised of a flexible and resilient material.

B. Base Member

Figure 2:
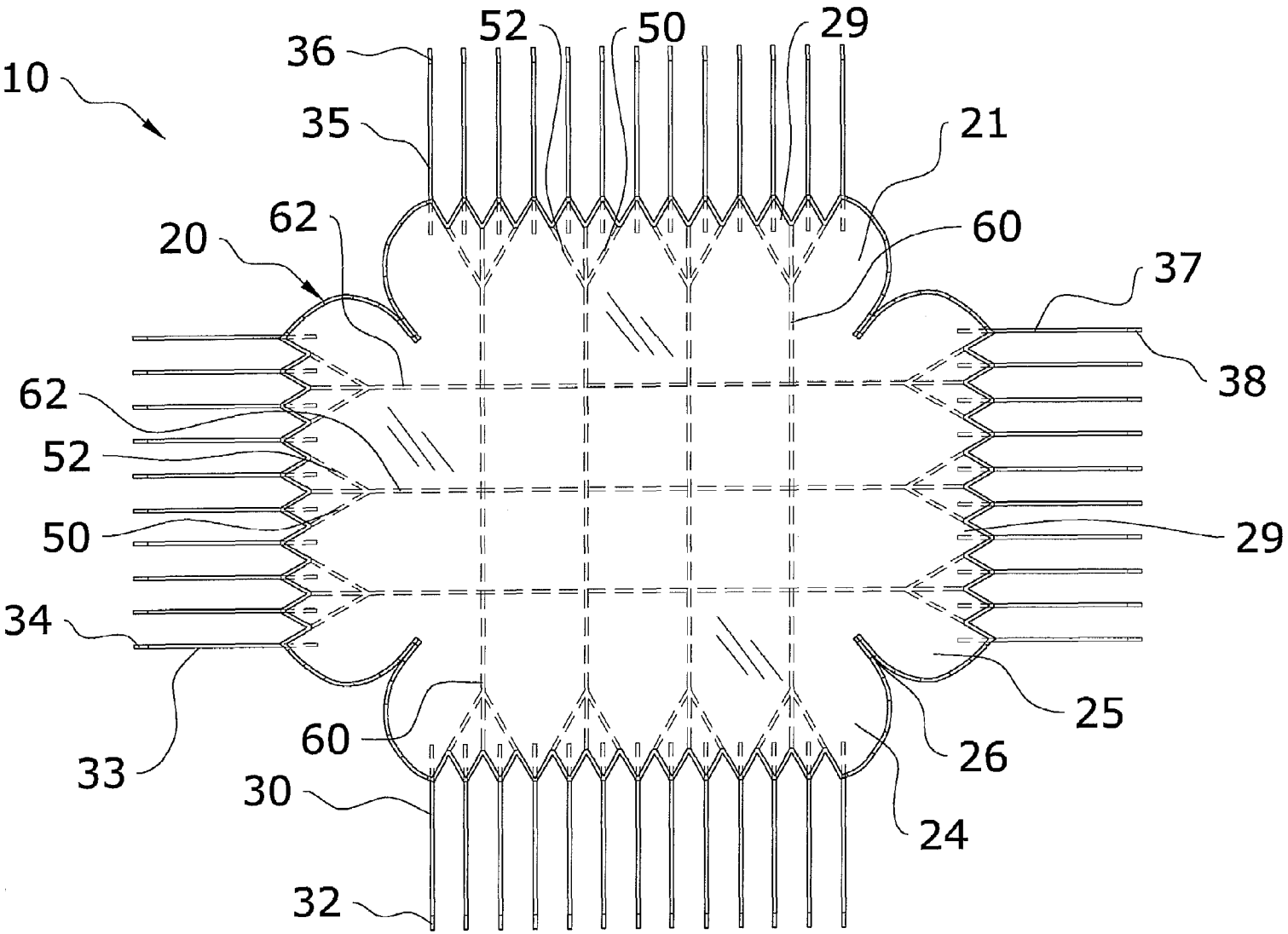
FIG. 2 is a top view of the present invention.
Figure 4:
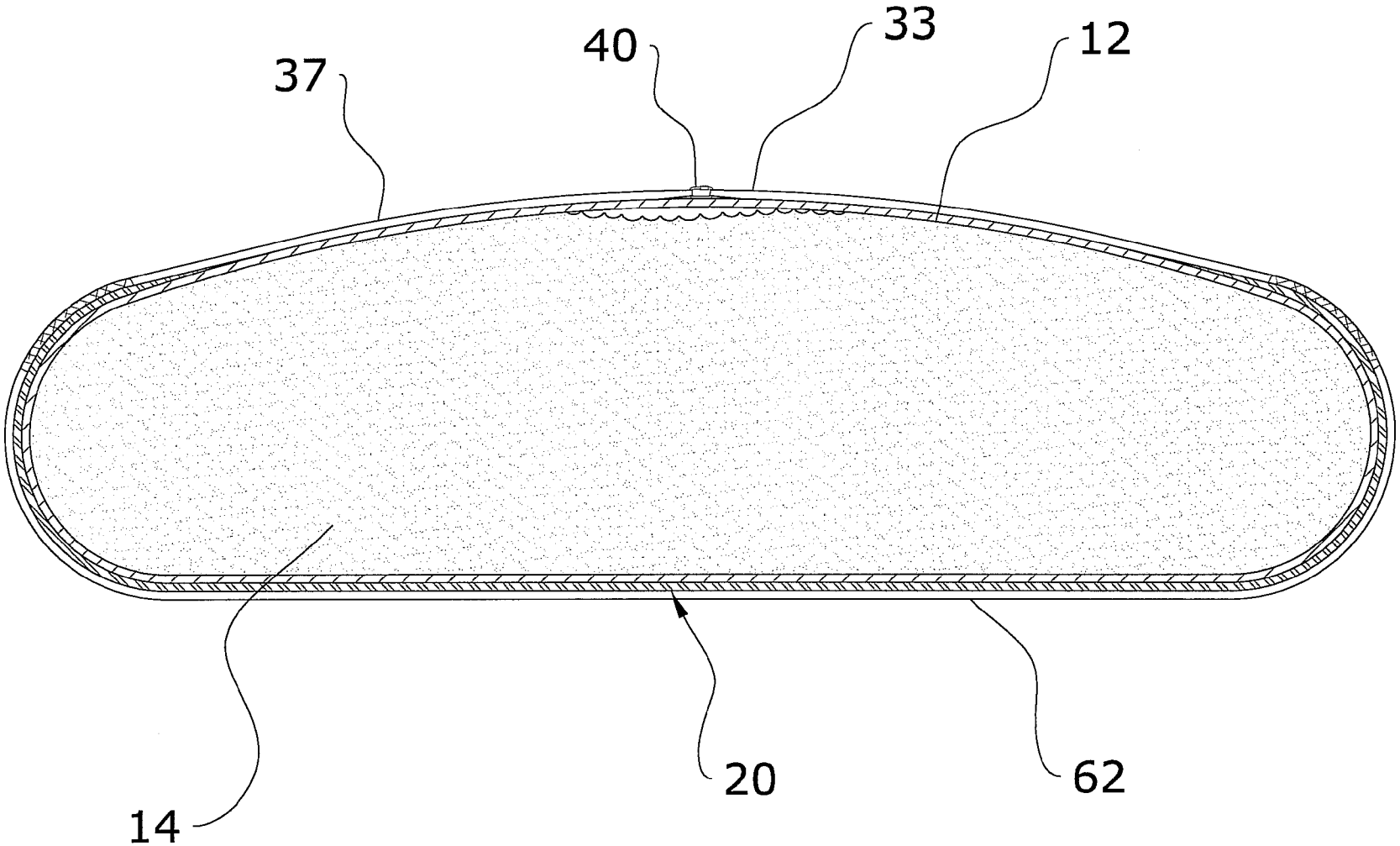
FIG. 4 is a cross sectional view of the present invention in use.

The base member 20 is preferably comprised of a substantially rectangular structure as illustrated in FIG. 2. The base member 20 is also preferably comprised of a flexible and resilient material to be able to stretch around the sides of a bladder unit 12. The base member 20 is preferably a separate structure than the bladder unit 12; however the base member 20 may be integrally formed with the bladder unit 12. The base member 20 when in use preferably curves inwardly around the bladder unit 12 and stops at a point on a top of the bladder unit 12 as illustrated in FIGS. 1 and 4. The curvature in the base member 20 will assist the rest of the bladder support system 10 in alleviating pressure on the bladder unit 12.

The base member 20 includes an inner surface 21 and an outer surface 22. When attaching the base member 20 to the bladder unit 12 the inner surface 21 is preferably positioned adjacent to the bladder unit 12 and the outer surface 22 is preferably positioned adjacent to the ground surface. The base member 20 includes four corners. The four corners each preferably include a first corner member 24 and a second corner member 25.

The first corner member 24 and the second corner member 25 preferably mirror each other. The first corner member 24 and the second corner member 25 preferably each form an arc-like structure as shown in FIG. 2. Further, the arc-like configuration of the first corner member 24 and the second corner member 25 preferably meet at an inner point. A corner slot 26 is preferably formed in-between the first corner member 24 and the second corner member 25 as shown in FIGS. 1 and 2. When attaching the base member 20 to the bladder unit 12 the first corner member 24 is preferably fastened to the second corner member 25. The first corner member 24 and the second corner member 25 are preferably fastened with a first fastener 27.

The first fastener 27 is preferably comprised of a lace material as shown in FIG. 1. The lace material is the preferred method to assist in aesthetics of the bladder support system 10 and to create a stronger attachment to the adjacent sides of the bladder support system 10 in order to handle the pressure of a full bladder unit 12. It is appreciated that other fastening devices may be used when fastening the first corner member 24 to the second corner member 25, such as but not limited to buckles, snaps and hook and loop configurations.

The base member 20 also preferably includes an outer edge 29. The outer edge 29 preferably extends from corner to corner and surrounds the base member 20. The outer edge 29 of the base member 20 is preferably comprised of at least one triangular wing. The outer edge 29 is also preferably comprised of a material substantially similar to the base member 20. Further, the outer edge 29 is preferably comprised of a minimum elongation fuel resistant material. The base member 20 along with the outer edge 29 are preferably slightly smaller than the bladder unit 12 as shown in FIG. 1 to assist the pressures against the walls of the bladder unit 12 to be transferred to the bladder support system 10.

It is appreciated that the outer edge 29 may be comprised of a plurality of triangular wings along each side of the base member 20 rather than a single triangular wing along each side of the base member 20. It is further appreciated that the structure of the outer edge 29 of the base member 20 may include any structure that improves the strength of the base member 20, rather than solely a triangular structure. The triangular wings of the outer edge 29 are preferably an integrally formed structure within the outer edge 29 of the base member 20; however the triangular wings of the outer edge 29 may be comprised of a separate structure.

The outer edge 29 is also preferably comprised of resilient and flexible material that can withstand the pressures of a full bladder unit 12. The triangular wings of the outer edge 29 are preferably spaced equidistance from each other as illustrated in FIGS. 1 and 2. The triangular wings are also preferably spaced 18-24 inches apart from each other at a pinnacle of the triangular wing. However, the spacing of the triangular wings may be greater or smaller than the desired 18-24 inches depending upon the size of the bladder unit 12 that the bladder support system 10 is used to support.

C. Straps

The straps 30, 33, 35 and 37 are preferably comprised of elongated structures as shown in FIGS. 1 through 4. The straps 30, 33, 35 and 37 are also preferably comprised of a webbing material to provide added strength to the bladder support system 10. The straps 30, 33, 35 and 37 are further preferably comprised of a flexible and resilient material. The straps 30, 33, 35 and 37 are also preferably 1-4 inches in width and have a length that is predetermined by the size of the bladder unit 12 that the bladder support system 10 will support. It is appreciated that the width of the straps 30, 33, 35 and 37 may be of various widths other than the preferred width to accommodate various size bladder units 12.

The straps 30, 33, 35 and 37 preferably extend from an apex of the triangular wings of the outer edge 29 in a longitudinal and latitudinal direction encasing the top of the bladder unit 12. The first straps 30 are preferably attached to a first side and near the outer edge 29 of the base member 20. The second straps 33 are preferably attached to a second side and near the outer edge 29 of the base member 20, where the second side is adjacent to the first side. The third straps 35 are preferably attached to a third side and near the outer edge 29 of the base member 20, wherein the third side is opposite the first side. The fourth straps 37 are preferably attached to a fourth side and near the outer edge 29 of the base member, wherein the fourth side is opposite the second side.

Figure 3:
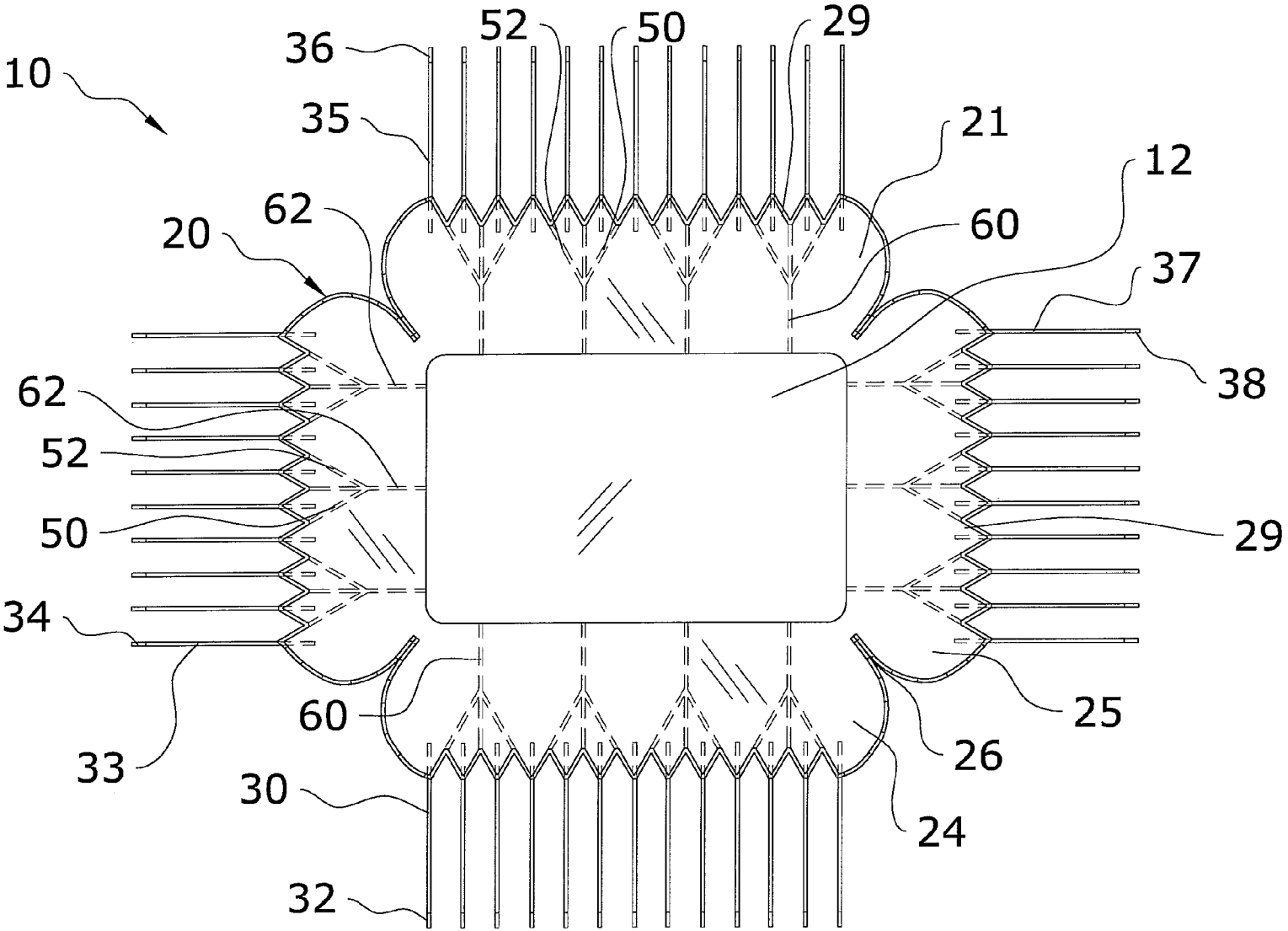
FIG. 3 is a top view of the present invention with a bladder unit.
Figure 5:
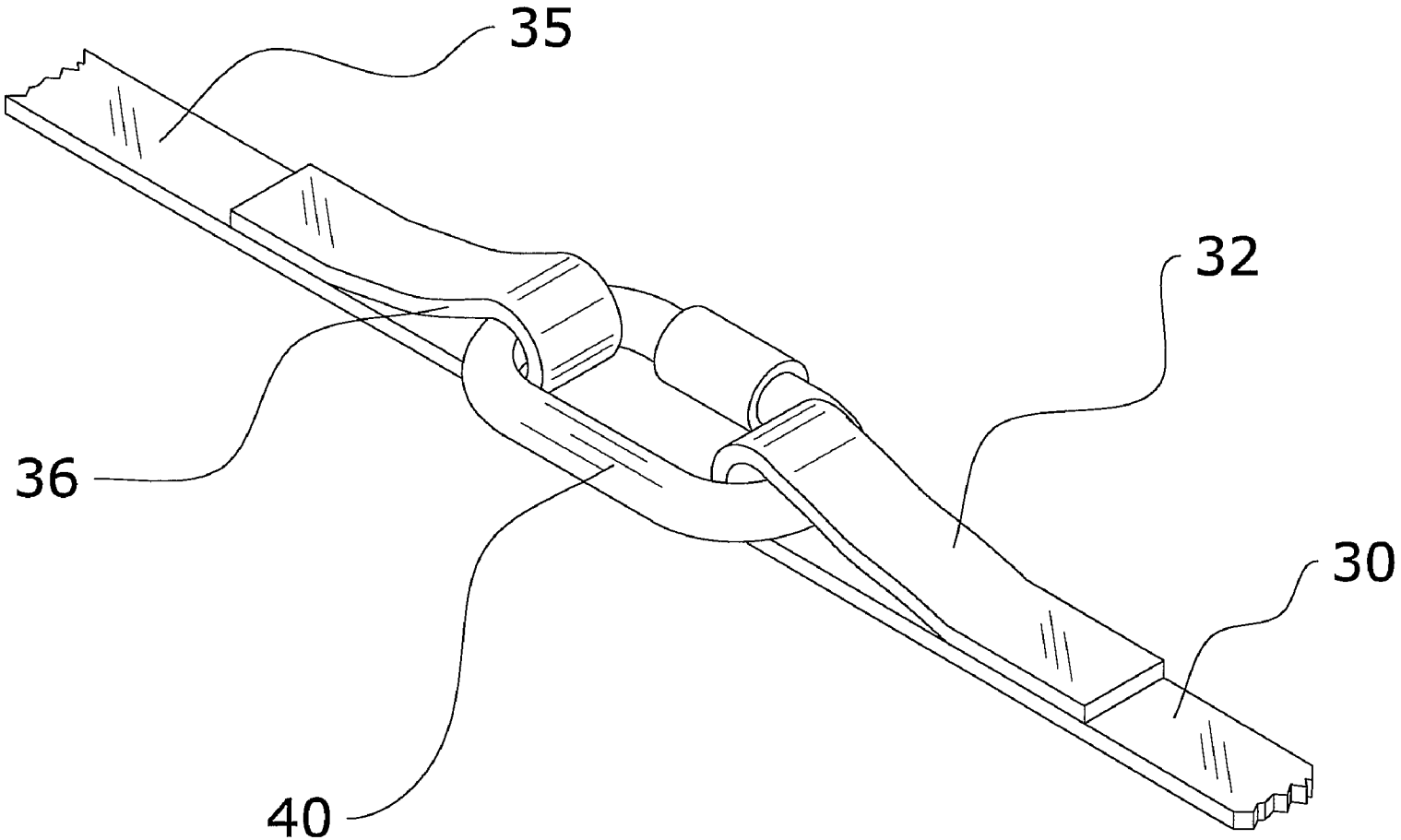
FIG. 5 is a magnified upper perspective view of two straps being connected by a fastener.

The straps 30, 33, 35 and 37 preferably overlap the outer edge 29 of the base member 20, wherein the straps 30, 33, 35 and 37 extend inwardly from the outer edge 29 to provide added strength to the bladder support system 10, as shown in FIGS. 2 and 3. The straps 30, 33, 35 and 37 each preferably include a connecting end 32, 34, 36 and 38. The connecting end 32, 34, 36 and 38 of the straps 30, 33, 35 and 37 is preferably comprised of a loop structure and configuration as shown in FIG. 5.

The loop is preferably formed by overlapping the strap 30, 33, 35 and 37 onto itself and sewn. It is appreciated that the loop may be formed in various other methods and it is further appreciated that the connecting end 32, 34, 36 and 38 of the strap 30, 33, 35 and 37 may by comprised of other various connecting structures and configurations. The connecting ends 32, 34, 36 and 38 of opposing straps 30, 33, 35 and 37 preferably removably attach to each other through a second fastener 40.

A first support strap 50 and a second support strap 52 preferably extend inwardly from the outer edge 29 of the base member 20. Each side of the base member 20 preferably includes at least one first support strap 50 and at least one second support strap 52. The first support strap 50 and the second support strap 52 preferably form a triangle configuration as illustrated in FIGS. 2 and 3. The first support strap 50 and the second support strap 52 are also preferably attached to the outer surface 22 of the base member 20.

A first connecting strap 60 and a second connecting strap 62 preferably extend inwardly from the apex of the triangle configuration formed by the first support strap 50 and the second support strap 52. The first connecting straps 60 preferably connect the first side of the base member 20 to the third side. The second connecting straps 62 preferably connect the second side of the base member 20 to the fourth side.

The configuration of the connecting straps 60, 62 are designed to displace or redirect some of the tension that is placed upon the straps 30, 33, 35 and 37, which encases the majority of a bladder unit 12. The straps 50, 52, 60 and 62 are also preferably sewn onto the outer surface of the base member 20; however it is appreciated that the straps 50, 52, 60 and 62 may be fabric welded or attached by any other means to the base member 20.

D. Second Fasteners

The second fastener 40 preferably connects opposing straps 30, 35 and 33, 37 that run along the top portion of a bladder unit 12 as shown in FIGS. 1, 4 and 5. The second fastener 40 is preferably comprised of a metal material that can withstand the pressures that will be placed upon it from a full bladder unit 12. The second fastener 40 is also preferably comprised of a D-ring structure to be able to easily attach and remove opposing connecting ends 32, 36 and 34, 38 as illustrated in FIGS. 1, 4 and 5. Preferably a second fastener 40 will connect opposing straps 30, 35 and 33, 37 at the longitudinal and latitudinal centers of the bladder unit 12.

E. In Use

In use, the base member 20 is first laid flat on the ground. An empty bladder unit 12 is then placed on top of the base member 20 in a manner so that the bladder unit 12 will be centered on the base member 20 as illustrated in FIG. 3. Once the bladder unit 12 is centered on the base member 20 the remaining portion of the base member 20 is curved upward to encase the bladder unit 12.

Once the base member 20 encases the bladder unit 12 the user can then position the straps 30, 33, 35 and 37 in a longitudinal and latitudinal manner along the top of the bladder unit 12. The user then properly positions all straps 30, 33, 35 and 37 in a manner that all straps 30, 33, 35 and 37 that oppose one another line up. The user can then connect the straps 30, 33, 35 and 37 by using the second fastener 40.

The user thereafter is able to fill the bladder unit 12 to a desired capacity. The first corner members 24 and the second corner members 25 are then attached using the first fasteners 27. Removably attaching the first corner members 24 to the second corner members 25 eliminates the excess fabric that occurs when the bladder support system 10 is in use making the bladder support system 10 aesthetically pleasing. To remove the bladder support system 10 from the bladder unit 12 the above process is simply reversed.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

We claim:

1. A bladder support system, comprising:

a bladder unit fillable with a fluid;

a base member comprised of a sheet structure, wherein said base member is positioned adjacent to said bladder unit; and a plurality of straps attached to said base member, wherein said plurality of straps are comprised of an elongated structure and wherein said plurality of straps are attached to said base member;

wherein said plurality of straps and said base member surround said bladder unit;

wherein each of said plurality of straps includes a first support strap and a second support strap, wherein said first support strap and said second support strap extend inwardly from an outer edge of said base member;

wherein said first support strap and said second support strap form a triangle configuration, wherein an apex of said triangle configuration extends inwardly from said outer edge.

2. The bladder support system of claim 1, wherein said first support strap and said second support strap are attached to an outer surface of said base member.

3. The bladder support system of claim 1, wherein said base member includes an outer edge comprised of at least one triangular wing.

4. The bladder support system of claim 3, wherein said at least one triangular wing includes a plurality of triangular wings formed in series along said outer edge of said base member.

5. The bladder support system of claim 4, wherein said plurality of straps extend outwardly from an apex of each of said plurality of triangular wings.

6. The bladder support system of claim 1, wherein said base member includes four corners, wherein each of said four corners includes a first corner member and a second corner member, wherein said first corner member and said second corner member form an opposing arc configuration.

7. The bladder support system of claim 6, wherein said first corner member and said second corner member are attached by a first fastener.

8. The bladder support system of claim 7, wherein said first fastener is comprised of a lace material.

9. The bladder support system of claim 1, wherein said plurality of straps each include a connecting end, wherein said connecting end is comprised of a loop structure.

10. The bladder support system of claim 9, wherein opposing said plurality of straps are removably attached through said connecting end via a second fastener.

11. The bladder support system of claim 10, wherein said second fastener is comprised of a D-ring structure.

12. The bladder support system of claim 1, wherein said base member is comprised of a substantially rectangular structure.

13. A bladder support system, comprising:

a bladder unit containing a fluid;

a base member including a first side, a second side adjacent to said first side, a third side opposite said first side and a fourth side opposite said second side and comprised of a sheet structure, wherein said base member is positioned adjacent to said bladder unit;

a plurality of first straps attached to said base member, wherein said plurality of first straps removably attach said first side and said third side of said base member; and a plurality of second straps attached to said base member, wherein said plurality of second straps removably attach said second side and said fourth side of said base member;

wherein said plurality of first straps and said plurality of second straps are comprised of an elongated structure;

wherein said plurality of first straps, plurality of second straps and said base member surround said bladder unit;

wherein each of said plurality of straps includes a first support strap and a second support strap, wherein said first support strap and said second support strap extend inwardly from an outer edge of said base member.

14. The bladder support system of claim 13, wherein said first support strap and said second support strap form a triangle configuration, wherein an apex of said triangle configuration extends inwardly from said outer edge.

15. The bladder support system of claim 13, wherein said first support strap and said second support strap are attached to an outer surface of said base member.

16. The bladder support system of claim 13, wherein said base member includes an outer edge comprised of at least one triangular wing, wherein said plurality of first straps and said plurality of second straps extend outwardly from an apex of said at least one triangular wing.

17. A bladder support system, comprising:

a bladder unit containing a fluid;

a base member including an outer edge, a first side, a second side adjacent to said first side, a third side opposite said first side and a fourth side opposite said second side and comprised of a sheet structure, wherein said base member is positioned adjacent to said bladder unit;

wherein said outer edge is comprised of a plurality of triangular wings;

a plurality of first straps attached to said base member, wherein said plurality of first straps attach to said first side of said base member;

a plurality of second straps attached to said base member, wherein said plurality of second straps attach to said second side of said base member;

a plurality of third straps attached to said base member, wherein said plurality of third straps attach to said third side of said base member and wherein said plurality of third straps removably attach to said plurality of first straps;

a plurality of fourth straps attached to said base member, wherein said plurality of fourth straps attach to said fourth side of said base member and wherein said plurality of fourth straps removably attach to said plurality of second straps;

wherein said plurality of first straps, plurality of second straps, plurality of third straps and plurality of fourth straps are comprised of an elongated structure;

wherein said plurality of first straps, plurality of second straps, plurality of third straps and plurality of fourth straps extend outwardly from an apex of each of each of said plurality of triangular wings;

a first support strap attached to said outer edge of said base member; and a second support strap attached to said outer edge of said base member, wherein said first support strap and said second support strap extend inwardly from said outer edge of said base member, wherein said first support strap and said second support strap form a triangle configuration;

wherein said first support strap and said second support strap are attached to an outer surface of said base member;

wherein said plurality of first straps, plurality of second straps, plurality of third straps, plurality of fourth straps and said base member surround said bladder unit.

18. A bladder support system, comprising:

a bladder unit filled with a fluid;

a base member comprised of a sheet structure having an inner surface and an outer surface, wherein said inner surface of said base member is positioned beneath and adjacent to said bladder unit; and a plurality of straps attached to said base member, wherein said plurality of straps are comprised of an elongated structure and wherein said plurality of straps are attached to said base member;

wherein said plurality of straps and said base member surround said bladder unit and wherein at least two of said plurality of straps are substantially overlapping and perpendicular relative to each other providing support to said bladder unit.

* * * * *